US006453995B2

(12) United States Patent
Gatherar et al.

(10) Patent No.: US 6,453,995 B2
(45) Date of Patent: Sep. 24, 2002

(54) TUBING HANGER SADDLE VALVE

(75) Inventors: Nicholas Gatherar, Juniper Green; Richard D. Kent, Newburgh, both of (GB)

(73) Assignee: FMC Technologies, Inc., Chicago, IL (US)

( * ) Notice: Subject to any disclaimer, the term of this patent is extended or adjusted under 35 U.S.C. 154(b) by 14 days.

(21) Appl. No.: 09/816,610

(22) Filed: Mar. 23, 2001

(30) Foreign Application Priority Data

Mar. 23, 2000 (GB) ..... 0007092

(51) Int. Cl.[7] ..... E21B 34/02

(52) U.S. Cl. ..... 166/75.14; 166/86.1; 166/86.2; 166/87.1; 166/95.1; 166/332.1

(58) Field of Search ..... 166/95.1, 97.1, 166/75.14, 332.1, 87.1, 86.2, 86.1

(56) References Cited

U.S. PATENT DOCUMENTS 1,944,573 A * 1/1934 Raymond et al. ..... 138/89
2,080,610 A * 5/1937 Humason ..... 166/87.1
2,118,094 A * 5/1938 McDonough et al. ..... 165/140
4,125,155 A * 11/1978 Brock, Jr. ..... 166/319
4,333,526 A * 6/1982 Watkins ..... 166/72
4,449,583 A * 5/1984 Lawson ..... 166/321
4,848,457 A * 7/1989 Lilley ..... 166/321
5,503,230 A * 4/1996 Osborne et al. ..... 166/321
5,706,893 A * 1/1998 Morgan ..... 166/75.14
6,039,119 A * 3/2000 Hopper et al. ..... 166/348

FOREIGN PATENT DOCUMENTS

GB 2218135 A 11/1989
GB 2243383 A 10/1991
GB 2319544 A 5/1998

* cited by examiner

*Primary Examiner*—Hoang Dang
(74) *Attorney, Agent, or Firm*—Henry C. Query, Jr.

(57) ABSTRACT

A tubing hanger incorporates a flow control valve that is ordinarily found in a horizontal christmas tree. A branch passage forming a production fluid outlet has a mouth that intersects with a vertical production bore. A valve closure element in the form of a rotatable sleeve or saddle is disposed in the bore for co-operation with a seat disposed in the branch passage. Rotation of the sleeve, e.g. by a shaft extending through a crown plug, brings a hole into or out of alignment with the seat to control production fluid flow. In other embodiments, the sleeve is axially movable.

14 Claims, 3 Drawing Sheets

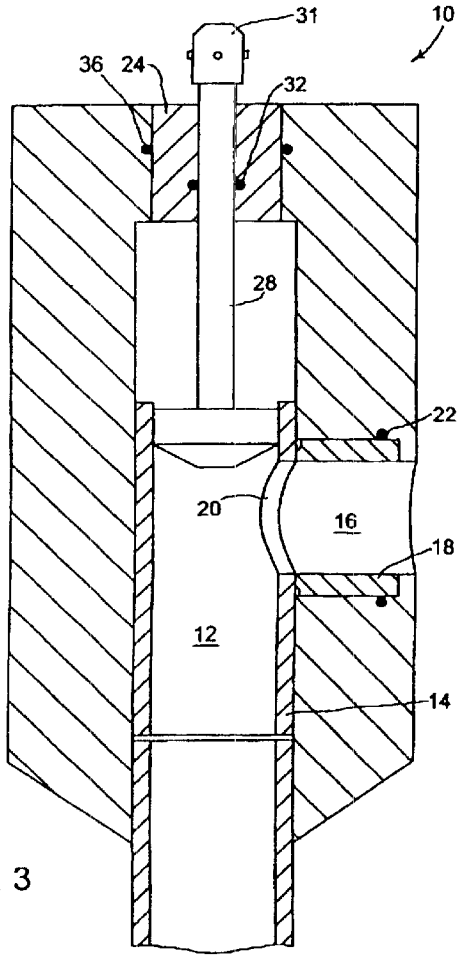
Fig. 3
Fig. 9
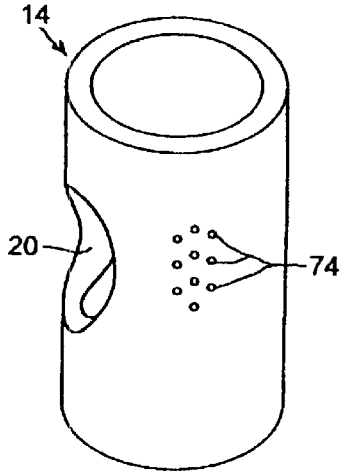
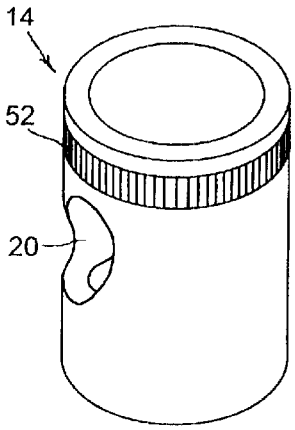
Fig. 6
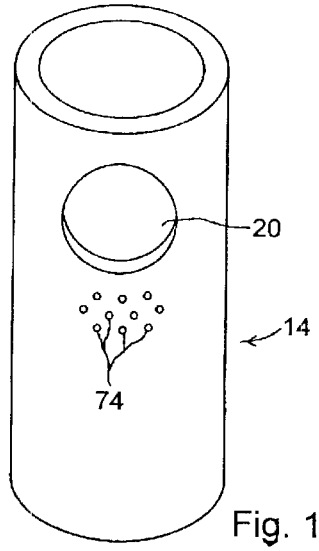
Fig. 10

TUBING HANGER SADDLE VALVE

BACKGROUND OF THE INVENTION

This invention concerns tubing hangers for horizontal christmas trees and the control of fluid flows from and within such trees.

A tubing hanger is used in oil and gas wells to hang the downhole tubing. In a horizontal christmas tree arrangement it is landed in and makes an annular seal with the christmas tree spool. Control of the production flow is via valves situated on the horizontal christmas tree, separate from the tubing hanger.

There are advantages in relocating the valves associated with the horizontal tree system from the christmas tree assembly itself to the tubing hanger. For example a production master valve located in the tubing hanger remains fully effective, independently of the condition of the tubing hanger/tree seal. Thus it may enable ready replacement of such seals. Moreover, such a valve is retrievable with the tubing hanger, whereas servicing of valves integral to the horizontal tree requires retrieval of the tubing hanger followed by retrieval the tree, a time consuming and costly operation. The positioning of valves in the tubing hanger simplifies the tree design and also enables other valves hitherto normally found in christmas trees to be located remotely from the wellhead, with advantages for installation, servicing and subsequent modification of well components and production flow control/processing equipment.

However relocation of valves from the tree to the tubing hanger is difficult, due to the size of the valves. Gate valves and ball valves are commonly used subsea equipment barriers, and have been used or proposed for use in tubing hangers or similar equipment such as internal tree caps. However the space required to accommodate these valves dictates larger tubing hanger and wellhead designs, with increased capital costs, increased component handling difficulties and hence increased operational costs.

A more effective valve design for use in tubing hangers for horizontal christmas trees is therefore desirable.

SUMMARY OF THE INVENTION

According to the invention there is provided a tubing hanger comprising a fluid flow passage and a branch passage having a mouth intersecting with the fluid flow passage, characterized in that a valve seat is disposed in the branch passage proximate to the mouth and a valve closure element is disposed in the fluid flow passage, the closure element being movable across the mouth and co-operating with the valve seat selectively to open or close off fluid communication between the flow passage and branch passage.

This valve configuration is suited to tubing hangers for horizontal christmas tree systems, in which the fluid flow passage comprises a vertically extending through passage connected to the tubing and the branch passage comprises a production fluid side outlet. However, this valve configuration may also be used elsewhere in the tubing hanger, for example in a tubing annulus bypass passage.

In either case, the valve closure element disposed in the fluid flow passage for selective closure of the branch passage in the manner defined above provides a particularly compact valve arrangement. The valve closure element may be movable in use substantially axially of the fluid flow passage, or about an axis extending along the fluid flow passage. Various means can be used to actuate the valve closure element. For example, it may be coupled to an operating shaft extending through a plug in the flow passage. It may comprise gear teeth engageable with a rack on a penetrator extending transversely of the fluid flow passage, or engageable with a pinion gear on a shaft extending lengthwise of the fluid flow passage. Alternatively, the closure element may be hydraulically actuated. The valve closure element may be biased towards the closed position, to provide fail safe closure.

The valve closure element may comprise a sleeve or part sleeve disposed adjacent to a wall of the fluid flow passage. It may contain an aperture selectively alignable with the branch passage mouth to provide said fluid communication. There may be one or more further smaller apertures likewise alignable with the mouth, to provide choked flow between the flow and branch passages.

The valve seat and/or the valve closure element may be mounted for floating movement axially of the branch passage in a manner that provides bi-directional sealing.

Further preferred features and advantages of the invention are in the following description of illustrative embodiments, made with reference to the drawings.

BRIEF DESCRIPTION OF THE DRAWINGS

FIGS. 2 and 3 are diagrammatic representations of further embodiments;

FIG. 6 is a perspective view of another alternative valve closure element;

FIGS. 9 and 10 show yet further alternative valve closure elements.

DETAILED DESCRIPTION OF THE PREFERRED EMBODIMENTS

Figure 1:
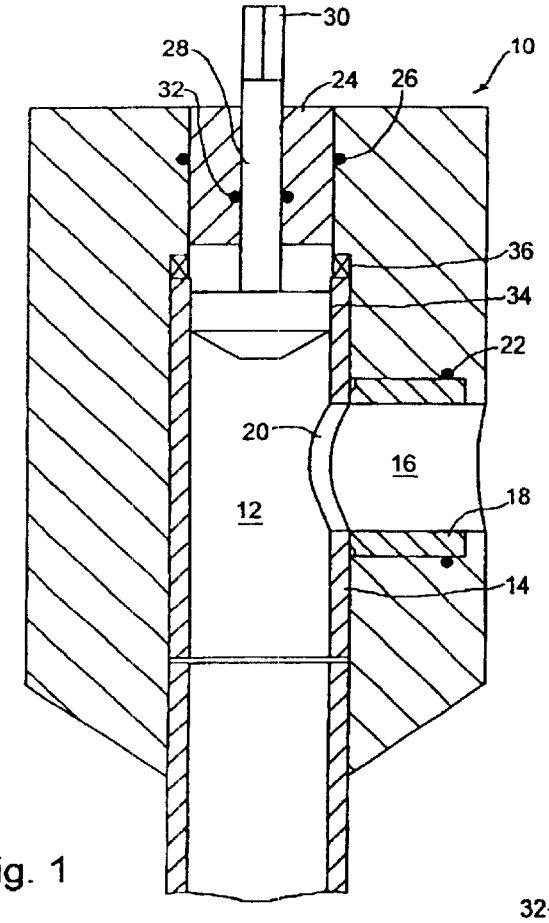
FIG. 1 diagrammatically represents a tubing hanger embodying the invention.

The tubing hangers 10 shown in FIGS. 1–3, 6 and 7 each incorporate a saddle or sleeve valve. This valve includes a valve closure element in the form of a sleeve 14 that sits astride and is retained in the fluid flow passage formed by the vertical production bore 12.

A horizontal production fluid outlet passage 16 branches off from the production bore 12. The mouth of the production fluid outlet passage 16 where it joins the production bore 12 accommodates a valve seat 18 arranged to seal against the outside surface of the sleeve 14. The seat 18 is allowed to float axially within the passage 16 and the sleeve 14 is allowed to float radially within the production bore 12 (i.e., also axially of the passage 16) so as to provide bi-directional sealing. The sleeve 14 wall contains a hole 20 whose cross section corresponds to that of the passage 16 and which can be moved into alignment with the seat 18 to permit fluid flow between the production bore 12 and the fluid outlet passage 16. An axial sliding seal 22 is provided between the seat 18 and the surrounding wall of the outlet passage 16, in known manner.

As shown in FIG. 1, the sleeve 14 is generally cylindrical. A plug 24, e.g. a wireline crown plug, and an annular seal 26 are used to seal the production bore 12 above the production fluid outlet passage 16. A rotatable actuating shaft 28 having a drive formation 30 engageable from above the tubing hanger 10 by a suitable tool (not shown) extends through the plug 24. A packing 32 is used to seal the shaft 28 within the plug 24. The connection 34 between the shaft 28 and the sleeve 14 is by means such as splines (not shown), capable of accommodating the radial floating movement of the sleeve 14. A thrust bearing 36 may be provided between an upper edge of the sleeve 14 and a shoulder in the production bore 16, the bearing likewise capable of accommodating the sleeve floating movement. Rotation of the drive formation 30 will bring the hole 20 into or out of alignment with the valve seat 18, so opening up or closing off fluid communication between the production bore 12 and production fluid outlet 16. The saddle valve thus formed effectively performs the function of a christmas tree master valve.

Figure 2:
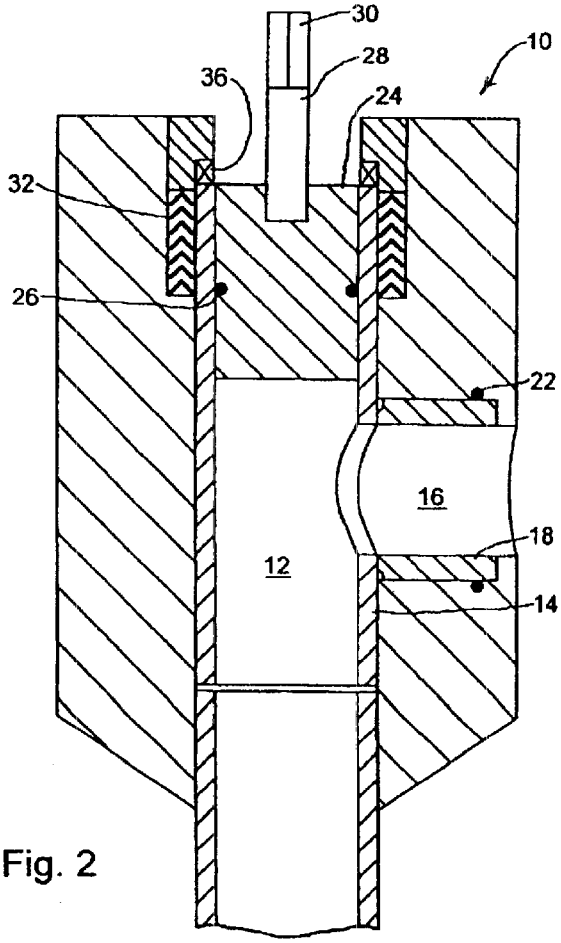

The tubing hanger shown in FIG. 2 is similar to that of FIG. 1, except that the plug 24 and seal 26 are provided in the upper end of the sleeve 14, above the hole 20, instead of directly in the production bore 12. The packing 32 is repositioned to surround the sleeve in the production bore 12 above the production fluid outlet 16, and in this embodiment accommodates the sleeve radial floating movement.

In the embodiment shown in FIG. 3, the shaft 28 is linearly movable by a suitable tool (not shown) engageable with a bayonet fitting 31. The sleeve 14 is thereby raised or lowered to bring the hole 20 into and out of register with the seat 18. If desired, a full bore plug or internal tree cap (not shown) installed in the christmas tree above the tubing hanger 10 can be used to hold the fitting 31 and shaft in the depressed (valve open) position.

Figure 4:
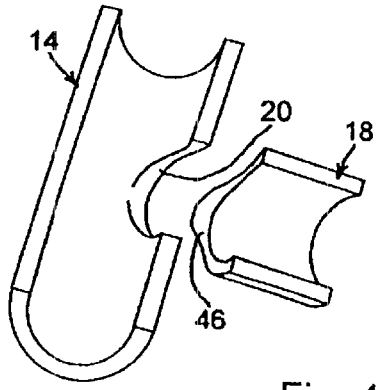
FIG. 4 is a cut away perspective view of a valve closure element and valve seat such as may be used in the above embodiments.

FIG. 4 is a perspective view showing half of a sleeve 14 and half of a corresponding seat 18, as may be used in the FIG. 1–3 embodiments. For illustrative purposes only, each component is shown cut along an axial central plane, to render interior surfaces visible. The seat 18 has a part cylindrical contoured end face 46 to match and form a metal to metal seal with the outer surface of the sleeve 14.

Figure 5:
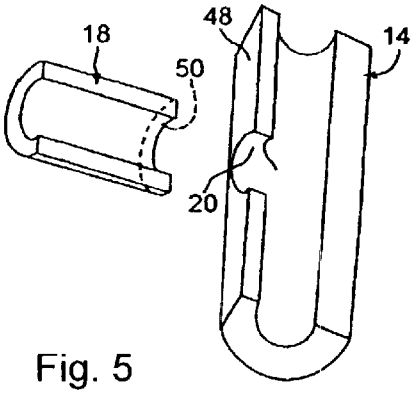
FIG. 5 is a cut away perspective view of an alternative valve closure element and valve seat such as may be used in the FIG. 2 and 3 embodiments.

FIG. 5 corresponds to FIG. 4, but shows a sectioned sleeve 14 and seat 18 for use in the FIG. 3 embodiment. The sleeve has a flat 48 machined along one side, for co-operation with a planar end face 50 on the seat 18. Vertically movable sleeves as used in FIG. 3 may take a wide variety of cross-sectional forms, as long as that cross section is uniform along that length of the sleeve which has to co-operate with the seat 18 or seals 38, 40, as the case may be.

FIG. 6 shows an alternative rotatable sleeve having circumferential gear teeth 52. These may co-operate with a rack axially driven by a horizontal penetrator suitably positioned on the christmas tree. Other geared drive arrangements are possible. For example the rack may be replaced by a pinion gear carried on a drive shaft extending upwardly through the tubing hanger. Alternatively, the circumferential gear teeth may be provided inside the upper end of the sleeve, for co-operation with a pinion gear and shaft extending through the plug 24, to replace the shaft 28 and drive connection 34 of the FIG. 1 embodiment, but offset from the plug central axis.

Figure 7:
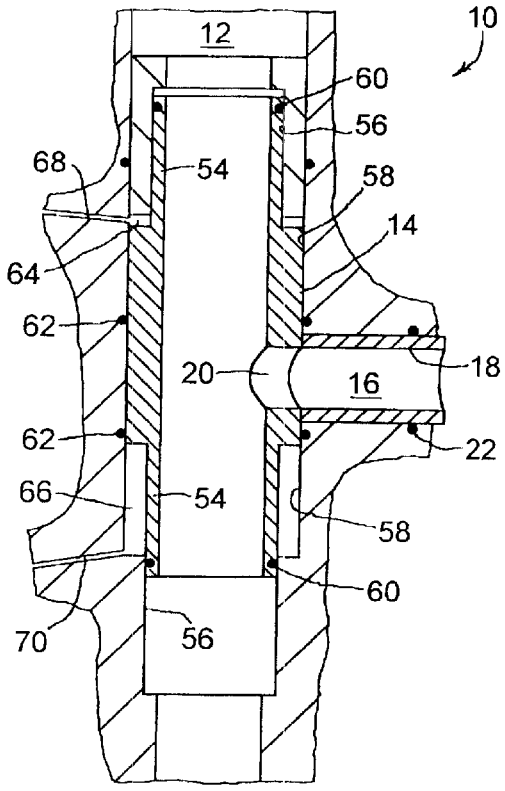
FIGS. 7 and 8 are part sectional views diagrammatically illustrating two further tubing hangers embodying the invention.

FIG. 7 shows another embodiment of the invention in which the sleeve 14 has end extensions 54 of reduced outside diameter. These slide in increased diameter portions 56 of the production bore 12. The full diameter portion of the sleeve 14 slides in a further increased diameter portion 58 of the production bore 12. Annular seals 60 are provided at the ends of the sleeve extensions 54 for co-operation with the increased diameter production bore portions 56. Further annular seals 62 are provided about the further increased diameter production bore portion 58, above and below the production fluid outlet 16, for sealing co-operation with the full diameter portion of the sleeve 14. This arrangement defines opposed annular hydraulic chambers 64, 66. A port 68 is used to supply hydraulic fluid to chamber 64, moving the sleeve 14 downwardly to the valve closed position. A port 70 supplies fluid to the chamber 70 to raise the sleeve 14 and open the valve.

Figure 8:
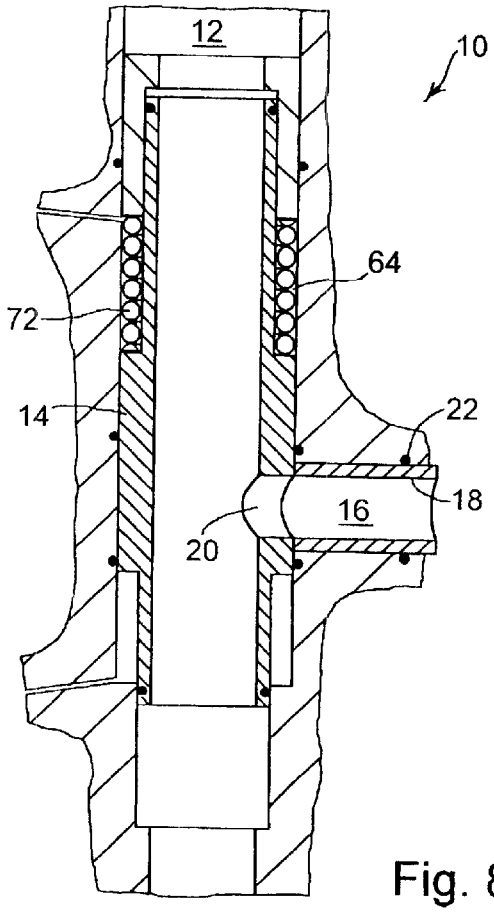

FIG. 8 is a modification of FIG. 7 in which chamber 64 is enlarged to accommodate a fail safe closure bias spring 72. Similar fail safe closure bias means could be provided in the other embodiments shown.

FIGS. 9 and 10 show sleeves 14 modified to provide choked flow as well as full flow and no flow. In the choked flow position, an array of small diameter through holes 74 is brought adjacent to the seat 18 (or between the seals 38, 40, FIG. 3). FIG. 9 shows the relative positions of holes 20, 74 in a rotationally positioned sleeve 14, and FIG. 10 an axially slidable sleeve 14. Still further arrays of choked flow holes could be provided, providing various flow rates. A continuous array of choked flow holes is possible, having a hole distribution density which varies in the direction of movement of the sleeve. Bringing different parts of the array into co-operation with the seat 18 thereby provides substantially continuously variable control of the flow rate. The FIG. 10 sleeve could include a flat as shown in FIG. 5.

Other forms of valve closure element will be apparent. The sleeve may not be a complete tubular structure, but instead could include an axial gap whereby it only partly surrounds the production bore 12 interior wall. In that case if rotationally positioned, the sleeve need not incorporate hole 20. In the case of an axially positioned sleeve, instead of having a hole 20, substantially the entire sleeve could be moved out of register with the seat 18. The closure element could take the form of a slab-like component having a sealing face shaped to conform to the co-operating surface of the seat and the adjacent interior wall surface portion of the production bore, the closure element lying near or against that surface portion.

It should be recognized that, while the present invention has been described in relation to the preferred embodiments thereof, those skilled in the art may develop a wide variation of structural and operational details without departing from the principles of the invention. For example, the various elements illustrated in the different embodiments may be combined in a manner not illustrated above. Therefore, the appended claims are to be construed to cover all equivalents falling within the true scope and spirit of the invention.

What is claimed is:

1. A tubing hanger (10) comprising a fluid flow passage (12), a branch passage (16) having a mouth intersecting with the fluid flow passage (12), a valve seat (18) disposed in the branch passage (16) proximate to the mouth and a valve closure element (14) disposed in the fluid flow passage (12), the closure element (14) being movable across the mouth and co-operating with the valve seat (18) selectively to open or close off fluid communication between the flow passage (12) and branch passage (16).

2. A tubing hanger as defined in claim 1, characterized in that the fluid flow passage (12) comprises a vertically extending through passage connected to the tubing and the branch passage (16) comprises a production fluid side outlet.

3. A tubing hanger as defined in claim 1, characterized in that the valve closure element (14) is disposed in a tubing annulus bypass passage.

4. A tubing hanger as defined in claim 1, characterized in that the valve closure element (14) is movable in use substantially axially of the fluid flow passage (12).

5. A tubing hanger as defined in claim 1, characterized in that the valve closure element (14) is movable in use about an axis extending along the fluid flow passage (12).

6. A tubing hanger as defined in claim 1, characterized in that the valve closure element (14) is coupled to an operating shaft (28) extending through a plug (24) in the fluid flow passage (12).

7. A tubing hanger as defined in claim 1, characterized in that the valve closure element (14) comprises gear teeth (52) engageable with a rack on a penetrator extending transversely of the fluid flow passage (12).

8. A tubing hanger as defined in claim 1, characterized in that the valve closure element (14) comprises gear teeth (52) engageable with a pinion gear on a shaft extending lengthwise of the fluid flow passage (12).

9. A tubing hanger as defined in claim 1, characterized in that the valve closure element (14) is hydraulically actuated.

10. A tubing hanger as defined in claim 1, characterized in that the valve closure element (14) is biased towards the closed position, to provide fail safe closure.

11. A tubing hanger as defined in claim 1, characterized in that the valve closure element (14) comprises a sleeve or part sleeve disposed adjacent to a wall of the fluid flow passage (12).

12. A tubing hanger as defined in claim 1, characterized in that the valve closure element (14) comprises an aperture (20) selectively alignable with the branch passage mouth to provide said fluid communication.

13. A tubing hanger as defined in claim 12, characterized by one or more further smaller apertures (74) likewise alignable with the mouth, to provide choked flow between the flow (12) and branch (16) passages.

14. A tubing hanger as defined in claim 1, characterized in that the valve seat (18) and/or closure element (14) is/are mounted for floating movement axially of the branch passage (16) in a manner that provides bi-directional sealing.

* * * * *